United States Patent [19]

Feliz

[11] Patent Number: 4,680,993

[45] Date of Patent: Jul. 21, 1987

[54] CHAMPAGNE BOTTLE OPENER

[76] Inventor: Jack M. Feliz, 2110 Southridge Dr., Palm Springs, Calif. 92264

[21] Appl. No.: 876,785

[22] Filed: Jun. 20, 1986

[51] Int. Cl.[4] ..... B67B 7/02

[52] U.S. Cl. ..... 81/3.37; 81/3.29

[58] Field of Search ..... 81/3.07, 3.37, 3.36, 81/3.29, 3.55, 3.56; 29/267

[56] References Cited

U.S. PATENT DOCUMENTS

| | | | |
|---|---|---|---|
| 3,800,345 | 4/1974 | Feliz | 81/3.37 |
| 4,527,450 | 7/1985 | Drosky | 81/3.37 |
| 4,590,821 | 5/1986 | Olson | 81/3.37 |
| 4,598,613 | 7/1986 | Baum | 81/3.37 |

FOREIGN PATENT DOCUMENTS

| | | | |
|---|---|---|---|
| 164955 | 12/1985 | European Pat. Off. | 81/3.07 |

*Primary Examiner*—Roscoe V. Parker

*Attorney, Agent, or Firm*—Harris, Kern, Wallen & Tinsley

[57] ABSTRACT

An improved champagne bottle opener comprising a flanged yoke-shaped cork extractor pivotally connected to a levered actuator and further pivotally connected to a flanged yoke-shaped platform which engages the flanged neck of a champagne bottle.

3 Claims, 7 Drawing Figures

CHAMPAGNE BOTTLE OPENER

BACKGROUND OF INVENTION

This invention relates to the improvement of a champagne bottle opener or the like. It has long been known that the removal of a cork from a champagne bottle is truly a formidable task and, in addition, the ejected cork can create an unacceptable safety hazard. It has been frequently evidenced where festive occasions have been turned into tragedy by a pressure ejected cork, which in effect becomes a flying missile capable of inflicting painful facial injuries and occasionally the loss of an eye.

SUMMARY AND OBJECTS OF INVENTION

In summary the chief aim of my invention is to provide a champagne bottle opener that is safer, easier and quicker to operate and less expensive to manufacture than may known types of champagne cork removers.

Another object of the present invention is to safely remove the cork under positively controlled conditions, thereby harmlessly relieving the internal gas pressure as the cork is being removed, thereby disarming a potential missile.

Another object of the present invention is to gradually release the gas pressure as indicated above thereby minimizing the escape of the carbon dioxide gas in which the vinters have expended considerable effort to produce and retain this highly desirable effervescent quality associated with champagnes.

Another object is to provide a means wherein the cork may be easily reinserted in the bottle and firmly retained in a closed position to prevent further escape of the gas, thereby maintaining the effervescent quality of the unconsumed champagne for extended periods of time.

Another object is to provide a safe, easy, and quicker means to extract corks and stoppers from pressurized containers and which, moreover, is light in weight, relatively simple in construction, and sturdy against easy derangement over long periods of use.

The foregoing objects, advantages, features and results of the present invention, together with various other objects, advantages, features and results thereof which will be evident to those skilled in the art to which the invention relates in the light of this disclosure, may be achieved with the exemplary embodiments of the invention illustrated in the accompanying drawings and described in detail hereafter.

DESCRIPTION OF EXEMPLARY EMBODIMENTS OF THE INVENTION

Figure 1:
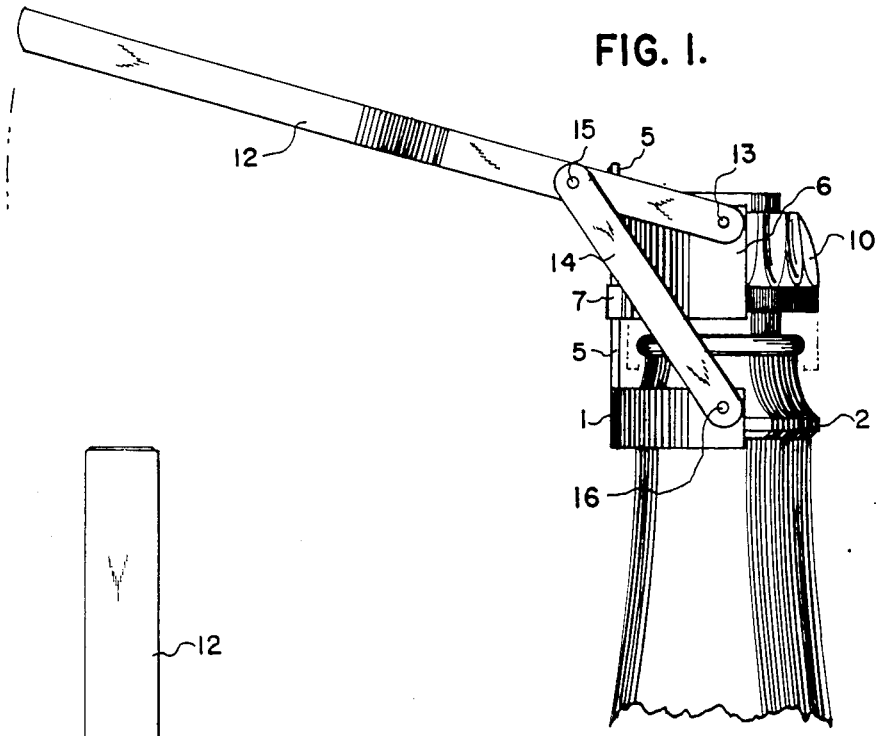
FIG. 1 is a side elevational view of the present invention, illustrating its engagement to a champagne bottle neck, the partially extracted cork, and the levered actuating means.
Figure 2:
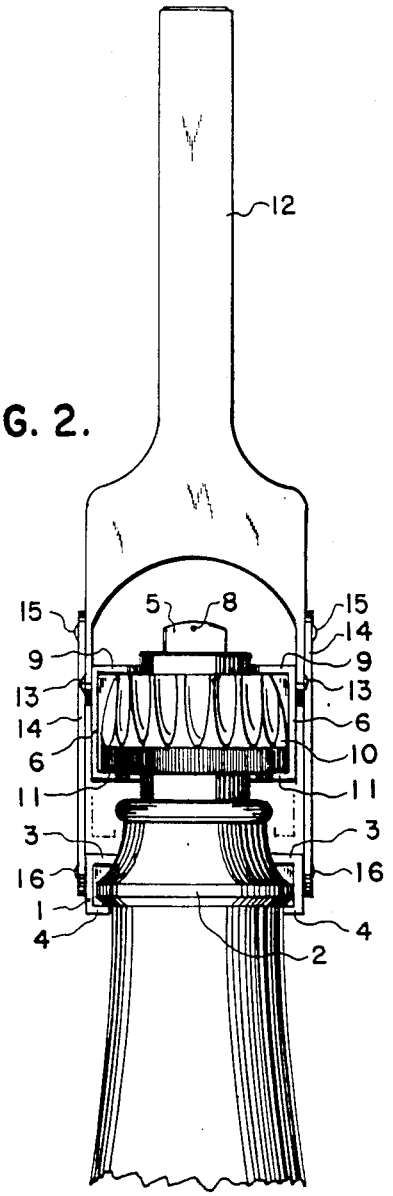
FIG. 2 is a front elevational view of the device or as it appears when viewed from the right of FIG. 1.
Figure 3:
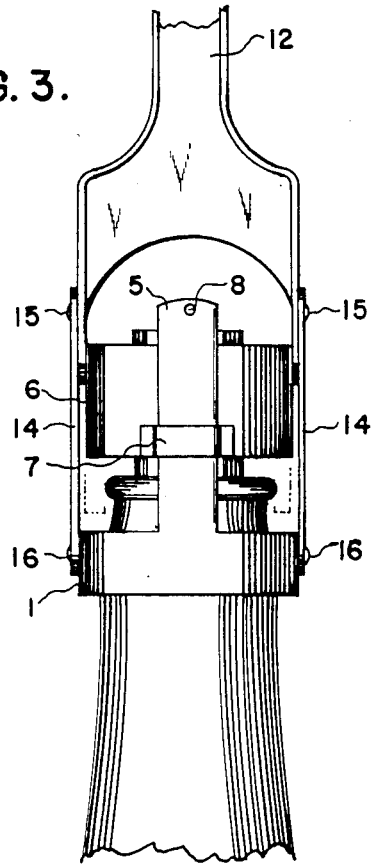
FIG. 3 is a rear elevational view of the device or as it appears when viewed from the left of FIG. 1.

Referring to FIGS. 1, 2, and 3 of the drawings, the flanged yoke-shaped platform 1 is shown engaged to the flanged bottle neck 2. The platform 1 is constructed from a channel bar shaped material (See FIG. 2) the upper flange 3 of the platform 1 provides the foundation which opposes the thrust generated by the levered actuating means, the latter will be described later. The lower flange 4 of the platform 1 functions as an additional resistance to the tendency of the platform 1 prongs to spread apart in view of the seating of flange 4 on the flared bottle neck 2. Referring now to FIGS. 1, 2 and more particularly to FIG. 3, a guide bar 5 is secured to the rear of platform 1, the purpose of this guide bar is to maintain a horizontal alignment between the platform 1 and the flanged yoke-shaped cork extractor 6, thereby preventing the said cork extractor and platform to tumble and become misaligned when not engaged to the cork and bottle neck.

Figure 4:
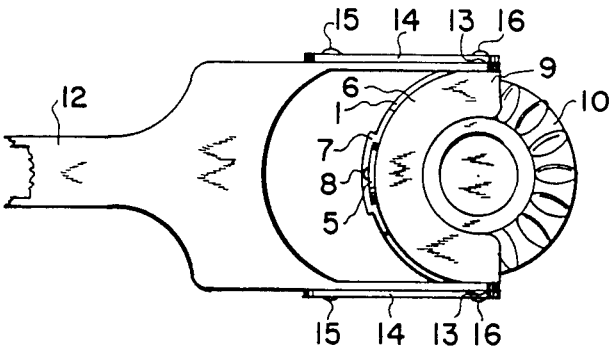
FIG. 4 is a plan view of the device.

The cork extractor 6 is similar in configuration to the platform 1. A slipper guide 7 is secured to the rear of the cork extractor 6, thereby permitting the cork extractor 6 to be slidably engaged to the platform guide bar 5. A round headed rivet 8 is secured to the upper end of the platform guide bar 5 to prevent disengagment of the cork extractor 6 from the platform bar 5, as best seen in FIGS. 2 and 4 the upper flange 9 of the cork extractor 6 serves three functions, first as a retainer to prevent the cork 10 from escaping while being extracted from the bottle thus preventing injury and or possible loss of an eye to the operator or other people in the near proximity, second the operator may fully reinsert the cork 10 in the bottle and safely retain the cork to prevent further escape of the carbon dioxide gas, thereby maintaining the effervescent quality of the unconsumed champagne for extended periods of time, and third the upper flange serves as an additional resistance to prevent the prongs of the cork extractor 6 from being forced apart as the cork is being extracted. The lower flange 11 of the cork extractor 6 is provided with serrations (not shown) on the upper face of the flange 11 to prevent the cork extractor 6 from slipping off from the cork 10 as the lifting force is applied. The flange 11 also functions as a resistance to prevent its prongs from being forced apart as the cork 10 is being extracted. In practice it may be necessary to form an upward hook on the flange 11 to prevent the said flange from slipping off from the cork 10 during its extraction from the bottle.

The levered actuating assembly shown in FIGS. 1, 2, 3 and 4, comprises a channel bar shaped handle 12 pivotally mounted to both sides of the cork extractor 6 as by rivets 13. The handle 12 is further pivotally mounted to the fulcra links 14 as by rivets 15, the opposite ends of the links 14 are pivotally mounted to the platform 1 as by rivets 16. Applying pressure downward on handle 12 will exert a downward thrust on the fulcrum links 14 and the resistable platform 1 and bottle neck 2. The resultant thrust will be directed upward to the cork extractors 6, thence to act upon the less resistable cork 10 and its subsequent extraction from the champagne bottle.

The advantage of the above invention is further amplified in that the three point pivotal action between the handle 12, fulcrum links 14, platform 1 and the cork extractor 6 are interconnected in a novel manner to achieve the following advantages, the fulcrum links 14 are permitted to move about their respective fulcra 16 as the distal end of the handle 12 moves downward on its fulcra 15 while the proximal end of handle 12 moves upward while pivoting about the rivets 13, thereby permitting the cork extractor 6 to move vertically while remaining in a horizontal plane in relation to the platform 1.

The above mentioned levered actuating means has the capability of maintaining the perpendicular axis of the extractor 6 in alignment with the perpendicular axis of the cork and the bottle, thereby preventing the cork 10 from binding in the bottle neck 2 and further to prevent the possible dislodgment of the bottle opener from the cork and bottle neck, further the above described linkage multiplies the force exerted on the cork extractor 6 as the handle 12 moves nearer to the bottle neck, and further the said linkage permits the bottle opener to fold up in a small area for easy stowage in a utility drawer or the like, and still further the above mentioned linkage will permit the complete extraction of the cork 10 in one easy downward thrust of the handle 12.

MODIFICATION TO THE CHAMPAGNE BOTTLE OPENER

Figure 6:
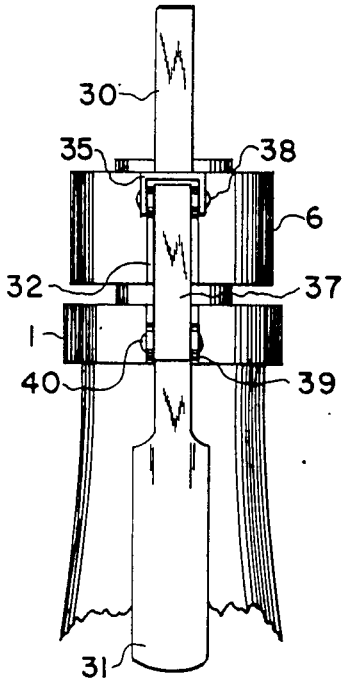
FIG. 6 is a rear elevational view of the modified device or as it appears when viewed from the left of FIG. 5.
Figure 7:
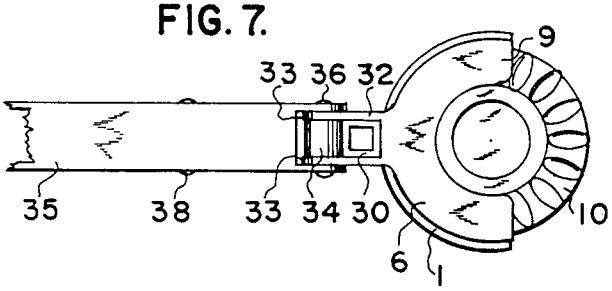
FIG. 7 is a plan view of the modified device.
Figure 5:
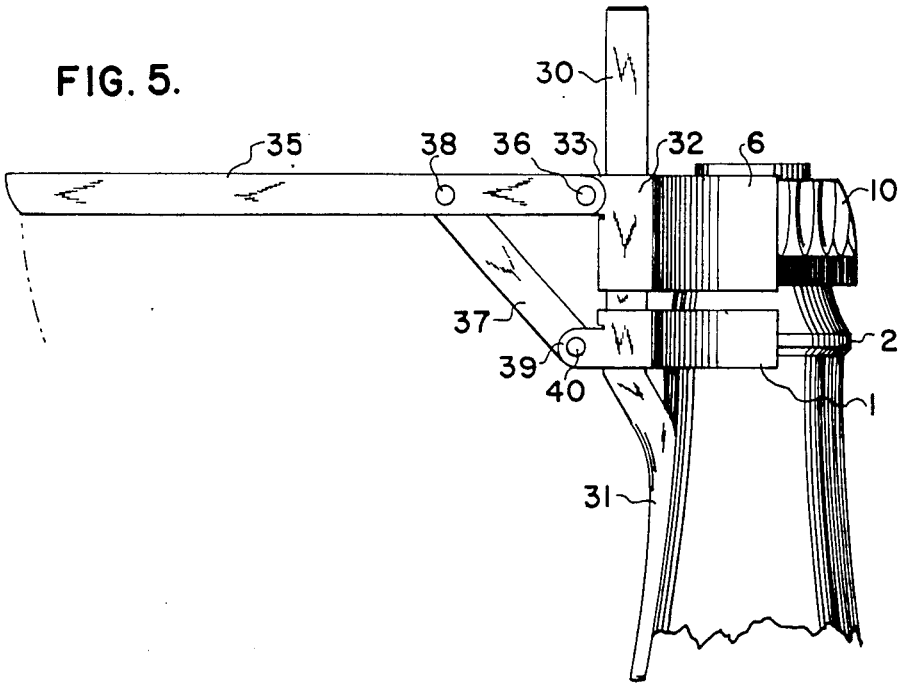
FIG. 5 is a side elevational view of a modification to the foregoing champagne bottle opener, illustrating the device engaged to a fully inserted cork, the bottle neck, and the levered actuating means.

Referring to FIGS. 5, 6 and 7 the modified champagne bottle opener comprises certain components having their counterparts in the first embodiment of the invention and are identified by the same reference numerals and only those features requiring a change of parts are identified by new reference numerals commencing with the number 30. A square guide column 30 is secured to the platform 1, extending upwardly and a semi-flattened buttress arm 31 is a downward extension of the square column 30.

The function of the buttress arm 31 is to oppose the thrust generated by the levered actuating assembly from dislodging the platform 1 and cork extractor 6 from their respective engagements to the bottle neck 2 and the cork 10. During the operation of the bottle opener one of the operators hands may encircle the buttress arm 31 and the neck of the bottle to further ensure that the engagement to the cork and bottle neck is maintained, the opposite hand will be free to force the levered handle 35 downward to effect the cork extraction. A square shaped slipper guide 32 is secured to the rear of the cork extractor 6, this configuration permits the cork extractor 6 to become slidingly engaged to the square column 30, a pair of brackets 33 (see FIGS. 5 and 7) are secured to the square slipper guide 32. The brackets 33 support the roller bearing 34 and the handle 35 which are rotatively borne on rivet 36, the roller bearing 34 serves to reduce the friction between the square guide 32 and the square column 30 as the cork extractor 6 is thrust upward. In practice if the friction between the inboard faces of column 30 and guide 32 is excessive, a low friction teflon material may be inserted in the guide 32, or another roller bearing may be substituted in the lower corner. A channel bar-shaped fulcrum link 37 (see FIGS. 5 and 6) is rotatively connected to the channel bar-shaped handle 35 by rivet 38, the lower end of link 37 is rotatively connected to brackets 39 as by rivet 40, the brackets 39 are secured to platform 1.

It will be evident that the above mentioned modification contains another novel cork extracting means by providing a guide column 30 integral with the platform 1 and the slidingly engaged cork extractor 6, as the latter is moved upward it will also maintain a horizontal plane in relation to the perpendicular axis of the cork 10 and the bottle neck 2. The three point configuration of the levered actuating means is identical to the one described in the first embodiment of the invention.

Although only two exemplary embodiments of the invention have been disclosed herein for purposes of illustration, it will be understood that various other changes, modifications and substitutions may be incorporated without departing from the spirit of the invention as defined by the claims which follow.

I claim as my invention:

1. In a champagne bottle opener, the combination of:

a. a flanged yoke-shaped platform having vertically spaced upper and lower flanges engageable to the flanged neck of a champagne bottle;

b. a flanged yoke-shaped cork extractor and retainer having vertically spaced upper and lower flanges engageable to the external top and bottom flanges of the cork, said extractor and retainer and said platform having interengageable guide means for maintaining said extractor and retainer in a horizontal plane while moving vertically in relation to said platform; and c. a single lever actuating means pivotally connected to said extractor and retainer and connected by a pivoted link to said platform, for moving said extractor and retainer vertically in relation to said platform;

d. with said platform and said extractor and retainer being laterally slideable into extracting position onto the corked bottle and with said cork being extracted by a single one-handed downward motion of said single lever.

2. A bottle opener as set forth in claim 1 wherein said actuating means has the capacity to multiply the force exerted on the cork extractor as the handle is moved downward, thus completely removing the cork in one easy thrust.

3. A bottle opener as set forth in claim 1 wherein said actuating means has the inherent capacity to fold up in a small area for easy stowage.

* * * * *